US005332490A

United States Patent [19]

Taylor, Jr. et al.

[11] Patent Number: 5,332,490

[45] Date of Patent: Jul. 26, 1994

[54] CATALYTIC PROCESS FOR DEWAXING HYDROCARBON FEEDSTOCKS

[75] Inventors: Robert J. Taylor, Jr.; Pei-Shing E. Dai, both of Port Arthur; Randall H. Petty, Port Neches; Joseph A. Durkin, Groves, all of Tex.

[73] Assignee: Texaco Inc., White Plains, N.Y.

[21] Appl. No.: 952,037

[22] Filed: Sep. 28, 1992

[51] Int. Cl.[5] ..... C10G 47/20

[52] U.S. Cl. ..... 208/111; 208/120; 208/216 PP; 502/313; 502/315

[58] Field of Search ..... 208/111, 120, 216 PP; 502/315, 313

[56] References Cited

U.S. PATENT DOCUMENTS

| | | | |
|---|---|---|---|
| 3,668,113 | 6/1972 | Burbidge et al. | 208/97 |
| 3,700,585 | 10/1972 | Chen et al. | 208/111 |
| 3,894,938 | 7/1975 | Gorring et al. | 208/97 |
| 3,980,550 | 9/1976 | Gorring et al. | 208/111 |
| 4,222,855 | 9/1980 | Pelrine et al. | 208/111 |
| 4,229,282 | 10/1980 | Peters et al. | 208/111 |
| 4,343,692 | 8/1982 | Winquist et al. | 208/111 |
| 4,428,862 | 1/1984 | Ward et al. | 502/77 |
| 4,458,024 | 7/1984 | Oleck et al. | 502/66 |
| 4,510,044 | 4/1985 | Oleck et al. | 208/111 |
| 4,743,355 | 5/1988 | Ward | 208/59 |
| 4,810,357 | 3/1989 | Chester et al. | 208/78 |

*Primary Examiner*—Johann Richter
*Assistant Examiner*—Michael B. Hydorn
*Attorney, Agent, or Firm*—James L. Bailey; Kenneth R. Priem; Walter D. Hunter

[57] ABSTRACT

A process for hydrodewaxing a hydrocarbon feedstock boiling above about 350° F. by contacting the feedstock and hydrogen at a hydrogen pressure of from about 300 to about 2000 psig at a temperature of 400° to 900° F. and at a space velocity of about 0.1 to about 10.0 LHSV with a catalyst comprising about 0.1 to about 23 wt. % of an oxide of a Group VIII metal, such as nickel, or an oxide of a Group VIB metal, such as molybdenum; supported on a porous alumina support containing about 50 to about 85 wt. % of a crystalline alumino-silicate zeolite of the ZSM-5 type based on the weight of the support. The catalyst is further characterized by having greater than 60% of the pore volume between 45-600 Angstroms in the 70-200 Angstrom range. The process is especially useful for dewaxing lubricating oil basestocks.

18 Claims, 2 Drawing Sheets

CATALYTIC PROCESS FOR DEWAXING HYDROCARBON FEEDSTOCKS

BACKGROUND OF THE INVENTION

1. Field of the Invention

This invention relates to a process for hydrodewaxing a hydrocarbon oil feedstock. More particularly, this invention is concerned with a catalytic process for hydrodewaxing a hydrocarbon oil feedstock such as a light hydrocarbon feedstock. It is further concerned with a process for manufacturing a high Viscosity Index (VI) distillate lubricating oil stock of low pour point and good stability.

In the hydrodewaxing process of this invention a waxy hydrocarbon oil feedstock, for example, and hydrogen are contacted at an elevated temperature and pressure with a catalyst comprising a specified amount of at least one metal oxide selected from the group consisting of an oxide of a Group VIII metal, such as an oxide of nickel or cobalt and an oxide of a Group VIB metal, such as an oxide of molybdenum or tungsten, supported on a porous support comprising a matrix or binder and a crystalline aluminosilicate zeolite.

In the catalytic hydrodewaxing process of this invention a hydrocarbon oil feed, such as a waxy hydrocarbon fraction, is contacted with hydrogen and the catalyst, which has a specified pore size distribution, in a manner such that a high viscosity index hydrocarbon oil is achieved in high yield.

2. Prior Art

Paraffin distillates and residual oils leaving the refinery crude stills contain wax and are normally solids at ambient temperatures. The deasphalting and refining processes increase the wax content of the lube feedstocks. Removal of the wax from these fractions is necessary to permit the manufacturing of lubricating oils with the desired low temperature properties. Catalytic and solvent dewaxing are the major processes used in the petroleum industry today for removing this wax.

The catalytic dewaxing process works by selectively cracking the waxy molecules over a zeolite catalyst. This differs from solvent dewaxing, where the wax is removed from the oil based on its solubility when dissolved in a suitable solvent. These different mechanisms for wax removal give the dewaxed oil product from the two processes different properties. Generally the dewaxed oil from solvent dewaxing of lighter feedstocks is obtained in a higher yield and has a higher viscosity index (VI) than that obtained from catalytic dewaxing. The loss in yield and VI observed for catalytic dewaxing compared with solvent dewaxing the same feedstock is called the yield and VI penalty. It is desirable to produce dewaxed oil from catalytic dewaxing without any yield or VI penalty.

The presently available commercial catalytic dewaxing processes which utilize a ZSM-5 containing catalyst work well for producing the heavy neutral oils and bright stocks. However, these processes suffer from severe yield and VI penalties when processing lighter feedstocks.

A number of other processes for catalytic dewaxing of hydrocarbon oils to reduce the temperature at which separation of waxy hydrocarbons occurs have been described in the art.

U.S. Pat. No. 4,743,355 discloses a process in which a waxy hydrocarbon feedstock is converted into a high quality lube oil stock of reduced pour point by hydrodewaxing the feedstock in the presence of catalyst comprising, for example, a porous refractory oxide such as alumina and a crystalline zeolite having a ZSM-5 zeolite structure and passing a portion of the effluent from the hydrodewaxing zone to a hydrocracking zone where it is a hydrocracking catalyst under conditions such that a further reduction in pour point is effected.

U.S. Pat. No. 4,458,024 teaches a single stage hydrotreating and hydrodewaxing process in which a petroleum residua is contacted with a catalyst comprising a ZSM-5 zeolite in an alumina binder. The catalyst employed has about 80% of its pore volume in pores no greater than 100 Angstrom units in diameter and at least 90% of its pore volume in pores no greater than 150 Angstrom units in diameter.

U.S. Pat. No. 3,668,113 discloses a process in which a hydrocarbon fraction is reduced in sulfur and n-paraffin wax content by first contacting the hydrocarbon fraction with a catalyst comprising a hydrogenating component and a crystalline mordenite to remove n-paraffin wax and then contacting the dewaxed fraction with a catalyst comprising a hydrogenating component on a refractory inorganic oxide to remove sulfur.

U.S. Pat. No. 3,700,585 teaches a dewaxing process in which a petroleum feedstock having a boiling point above 350° F. is contacted with a zeolite ZSM-5 or ZSM-8 having an associated hydrogenation component and, optionally, in the presence of hydrogen.

U.S. Pat. No. 3,894,938 discloses a process for dewaxing and desulfurizing high pour point high sulfur gas oil in which the gas oil is first contacted with a ZSM-5 type zeolite which may contain a hydrogenation component in the presence or absence of added hydrogen followed by conventional hydrosulfurization processing.

U.S. Pat. No. 3,980,550 discloses a process for dewaxing a gas oil by contacting the gas oil with hydrogen in the presence of a catalyst such as a ZSM-5 type having at least one multi-valent transition metal, such as zinc, and a noble metal, such as platinum.

U.S. Pat. No. 4,229,282 teaches a catalytic dewaxing process in which a hydrocarbon oil is contacted in the presence of hydrogen with catalyst comprising a dense zeolite, such as a dense ZSM-5 zeolite and a hydrogenation component.

U.S. Pat. No. 4,222,855 discloses a process in which waxy hydrocarbon oils are catalytically dewaxed utilizing a catalyst comprising a hydrogenation metal and a crystalline aluminosilicate such as ZSM-23 or ZSM-35.

U.S. Pat. No. 4,343,692 teaches a hydrodewaxing process in which a petroleum feedstock such as a petroleum distillate or residual fraction and hydrogen are contacted with a catalyst wherein the catalyst is a synthetic ferrierite zeolite containing at least one metal selected from the group consisting of Group VIB, Group VIIB and Group VIII metals.

U.S. Pat. No. 4,810,357 discloses a process for dewaxing relatively heavy or relatively light lube chargestocks in two parallel separate reactors where the catalyst employed in the reactor used for dewaxing the relatively light chargestock is a zeolite catalyst such as ZSM-22, ZSM-23 or ZSM-35 while in the reactor used for dewaxing the relatively heavy chargestock the catalyst used is a zeolite such as ZSM-5, ZSM-11, etc.

U.S. Pat. No. 4,428,862 discloses a process for hydrodewaxing shale oil feeds in which a catalyst comprising a Group VIB metal in a support containing silicalite and a porous refractory oxide.

U.S. Pat. No. 4,510,044 discloses a single stage hydrodewaxing and hydrotreating process in which hydrogen and a petroleum residua is contacted with a catalyst comprising a ZSM-5 type zeolite in an alumina binder having a hydrogenation component and having 90% of its pore volume in pores no greater than 150 Angstroms in diameter.

SUMMARY OF THE INVENTION

The instant invention is a process for hydrodewaxing a hydrocarbon oil feedstock boiling above about 350° F. such as light waxy feedstocks including, for example, light waxy distillates, raffinates and hydrorefined oils which comprises contacting said oil and hydrogen at a hydrogen pressure of from about 300 to about 2000 psig, a temperature of from about 400° to about 900° F. and at a space velocity of about 0.1 to about 10.0 LHSV with a catalyst which comprising about 0.1 to about 23 wt. %, preferably about 1 to about 11 wt. % based on the total weight of the catalyst, of at least one metal oxide selected from the group consisting of an oxide of a Group VIII metal, preferably nickel or cobalt; and an oxide of a Group VIB metal, preferably tungsten or molybdenum; supported on a porous support comprising a matrix containing about 50 to about 85 wt. %, preferably about 65 to about 85 wt. % of a crystalline aluminosilicate zeolite of the hydrogen form, based on the weight of the support. The catalyst is further characterized by having greater than 60% of the pore volume between 45-600 Angstroms in the 70-200 Angstrom range.

In this specification and in the claims the term "hydrodewaxing" is used in its broadest sense and is intended to mean a process conducted in the presence of hydrogen wherein those hydrocarbons which readily solidify (waxes) from petroleum stocks are converted or removed.

This invention also relates to the catalyst employed in the described process.

Any hydrocarbon oil, regardless of the source that boils above about 350° F. and has an unacceptable content of waxy components such that its pour point is in excess of that required for a given product may be hydrodewaxed by the process of this invention. For example, hydrocracked oils, oils from coal or tar sands and especially petroleum oils may be treated using the process of this invention to produce lube oil, jet fuel, diesel fuel, or any of a number of other petroleum oil products of reduced pour point.

The catalytic hydrodewaxing process of this invention is conducted, for example, by contacting the feed to be dewaxed with a fixed stationary bed of catalyst, with a fixed fluidized bed or with a transport bed, as desired. One preferred configuration is a trickle-bed operation in which the feed is allowed to trickle through a stationary fixed bed in the presence of hydrogen. Generally, in order to obtain maximum benefits from this invention it is desirable to initiate the reaction with fresh catalyst at a relatively low temperature such as 500° to 600° F. As the catalyst ages its temperature is of course raised in order to maintain high catalytic activity. Usually, for lube oil base stocks the run is terminated when the temperature reaches about 700° F. after which regeneration of the catalyst can be achieved by contacting the catalyst, for example, at an elevated temperature with hydrogen gas.

The dewaxed oil obtained from the process of this invention has a higher viscosity index and is obtained in higher yield than that obtained from prior art processes. This process is especially useful for dewaxing light waxy feedstocks where large yield and VI losses are observed in the process known in the art.

DESCRIPTION OF THE PREFERRED EMBODIMENTS

Figure 1:
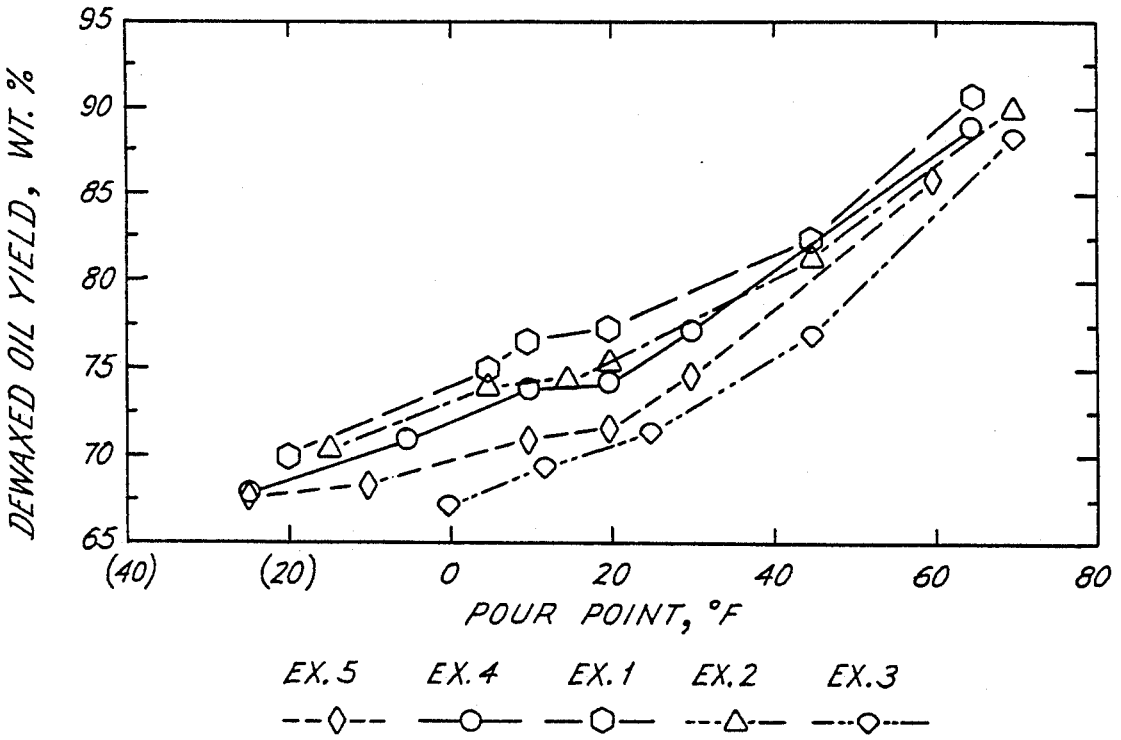
FIG. 1 illustrates the yield of dewaxed oil (wt. %) achieved in Examples 1 and 2 of the present invention and in Comparative Examples 3, 4 and 5 plotted against the pour point (°F.) using data from Tables II-VI.

The hydrodewaxing process of this invention is useful for reducing the pour point of a wide variety of hydrocarbon oil feedstocks ranging from light distillate fractions up to high boiling feedstocks such as whole crude petroleum, reduced crudes, vacuum tower residua, e.g., brightstock, cycle oils, gas oils, vacuum gas oils, etc. This process is particularly useful for treating waxy distillate stocks, such as gas oils, kerosenes, jet fuels, lubricating oil stocks, hydrotreated oil stock, heating oils, solvent-extracted lubricating oil stock and other distillate fractions where the pour point and viscosity values must be within certain specification limits.

The catalyst employed in the process of this invention preferably comprises about 0.1 to about 23 wt. %, based on the total weight of the catalyst, of at least one metal oxide selected from the group consisting of an oxide of a Group VIII metal and an oxide of a Group VIB metal, supported on a porous support, comprising a matrix containing about 65 to about 85wt. % of a crystalline aluminosilicate zeolite based on the weight of the support and wherein the catalyst is further characterized by having greater than about 60% of the pore volume in pores between 45-600 Angstroms in diameter in the range of about 70 to about 200 Angstroms. Group VIB and Group VIII as referred to herein are Group VIB and Group VIII of the Periodic Table of Elements. The Periodic Table of Elements referred to herein is found on the inside cover of the *CRC Handbook of Chemistry and Physics*, 55th Ed. (1974-75). The above-described support may be purchased or prepared by methods well known to those skilled in the art. Similarly, the support material may be impregnated with the requisite amounts of the above-described Group VIB and VIII metal oxides via conventional means known to those skilled in the art.

A wide variety of zeolites may be employed in preparing the catalyst of this invention. Particularly useful zeolites include:

ZSM-5, ZSM-11, ZSM-12, ZSM-23, ZSM-35, ZSM-38, mordenite and other similar materials. U.S. Pat. No. 3,702,886, describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-38 is more particularly described in U.S. Pat. No. 4,046,859, the entire contents of which are incorporated herein by reference.

The activity and selectivity of the zeolite for selectively cracking the waxy molecules is mainly determined by the structure and acidity of the zeolite framework.

The structure of the zeolite framework is determined by the method of preparation. Different zeolite structures have different framework pore openings, which are important in the selectivity of the catalyst. The catalyst selectivity comes from the ability of the zeolite to discriminate between wax and oil molecules based on size. In ZSM-5, the straight chain and slightly branched chain waxy molecules can enter the zeolite channels while the bulky oil molecules cannot. Since the active cracking sites are inside the channels of the zeolite, access to these sites is important. If the pore openings are too large the catalyst shows no selectivity because either the wax or the oil molecules can get to the active sites and if they are too small it shows no activity because neither type of molecules can get to the active sites.

The acidity of the zeolite has a major influence on the cracking activity of the catalyst and is determined by both the method of zeolite preparation and the type of post-treatment the zeolite receives. Zeolites are crystalline aluminosilicates and their acidity is greatly affected by the $SiO_2/Al_2O_3$ molar ratio, i.e., the SAR ratio in the framework. The SAR can affect both the total number of acid sites as well as the strength of the sites. Generally in preparing the catalysts of this invention zeolites having a SAR of about 30 to about 400, preferably from about 40 to about 150, are employed.

The support utilized in preparing the catalyst of this invention comprises a matrix or binder together with the above-described crystalline aluminosilicate zeolite. A wide variety of matrix materials which are resistant to the temperature and other conditions employed in this process can be used. Usually, the support will comprise about 50 to about 85 wt. %, preferably about 65 to about 85 wt. % of the zeolite, based on the weight of the support, with the balance being a suitable matrix material. Such matrix materials include, for example, inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the subbentonites and the kaolins commonly known as Dixie, McNamee-Georgia and Florida clays or others in which the main mineral constituent is halloysite, kaolinite, dickite, macrite or anauxite. Such clays can be used in the raw state as originally mined or initially subjected to calcination, acid treatment or chemical modification.

In addition to the foregoing materials, the zeolites employed herein to prepare the catalyst composition may be composited with a porous matrix material, such as alumina, silica-alumina, silica-magnesia, silica-zirconia, silica-thoria, silica-beryllia, silica-titania as well as ternary compositions, such as silica-alumina-thoria, silica-alumina-zirconia, silica-alumina-magnesia and silica-magnesia-zirconia, etc.

Generally, the hydrodewaxing process of this invention is conducted at a temperature of about 400° F. to about 900° F., preferably at about 500° to about 700° F., at a LHSV of about 0.1 to about 10.0, preferably at about 0.5 to about 4.0, at a pressure of about 100 to about 2000 psig, preferably at about 300 to about 600 psig and at a hydrogen circulation rate of about 1000 to about 15,000 SCFB (standard cubic feet per barrel of feed), preferably at about 2000 to about 4000 SCFB.

In preparing the catalyst the support containing the crystalline aluminosilicate is impregnated via conventional means known to those skilled in the art with the requisite amount of the metal compound or compounds which will provide on the support of the finished catalyst at least one metal oxide selected from the group consisting of an oxide of a Group VIII metal and an oxide of a Group VIB metal. The finished catalyst will comprise about 0.1 to about 23 wt. %, preferably about 1 to about 11 wt. % of the metal oxide or oxides on the support, based on the total weight of the catalyst.

The Group VIII metal may be iron, cobalt or nickel which is loaded on the support, for example, as an about 0.3 to about 22 wt. %, preferably about 3 to about 15 wt. % of an aqueous solution of metal nitrate. The preferred metal of this group is nickel which may be employed as an about 0.5 to about 34 wt. % aqueous solution of nickel nitrate hexahydrate. The Group VIB metal may be tungsten, molybdenum or chromium, preferably tungsten, employed typically as an about 2 to about 30 wt. % preferably about 7 to about 18 wt. %, of an aqueous solution of ammonium metatungstate.

The active metal or metals may be loaded onto the catalyst support via pore filling impregnation. Although it is possible to load each metal separately when the support is loaded with metals from both Group VIII and Group VIB, it is preferred to impregnate the support with the Group VIII and the Group VIB metals simultaneously utilizing an impregnating solution containing both metals. Stabilizers such as hydrogen peroxide and citric acid (monohydrate) may be employed as a component of the impregnating solutions.

Finally, the impregnated support is oven-dried and then directly calcined preferably at 1000°-1150° F. for about 20 minutes to 3 hours or more in flowing air.

The catalyst employed is characterized by having a greater than 60% of the pore volume in pores between 45-600 Angstroms in diameter in the range of about 70 to about 200 Å. The catalyst is further characterized by having about 50 to about 60% of the total pore volume in pores having diameters less than 100 Angstroms.

EVALUATION OF THE CATALYSTS-EXAMPLES 1-5

The feedstock used in Examples 1-5 was a light neutral waxy stock which had been MP solvent refined and hydrogen finished at low hydrogen pressure and low temperature over a Ni/Mo/alumina catalyst. The feedstock properties are shown in Table I below.

TABLE I

| FEEDSTOCK PROPERTIES | |
|---|---|
| Tests | |
| API Gravity | 35.0 |
| RI @ 70 C | 1.4515 |
| ASTM Color | <0.5 |
| Flash, COC | 385° F. |
| ASTM Pour | 80° F. |
| Neutral Number | 0.02 |
| Viscosity, 65.6° C., cSt | 7.94 |
| Viscosity, 100° C., cSt | 3.83 |
| Viscosity Index | 116 |
| NMR Hydrogen, wt. % | 14.03 |
| Sulfur, wt. % | 0.11 |
| Basic Nitrogen, ppm | 3 |
| MCRT, wt. % | 0.02 |
| Ash, wt. % | 0 |
| TBP by GC Temp, F D2887 | |
| IBP/1% off | 573°/615° F. |
| 3/5 | 653°/669° F. |
| 10/20 | 689°/713° F. |
| 30/40 | 730°/744° F. |
| 50/60 | 759°/774° F. |
| 70/80 | 790°/809° F. |
| 90/100 | 838°/863° F. |
| 98/FBP | 890°/917° F. |
| Wt. % Oil (+68° F. Pour), SP488 | 93.2 |
| Wt. % Oil (+32° F. Pour) | 83.0 |
| Wt. % Oil (−4° F. Pour) | 78.9 |
| Wt. % Oil (−40° F. Pour) | 76.4 |

Crude Source (%): 42.4 Arabian Light Berri, 32.4 Scurry, 12.0 Lafitte-Paradis, 11.0 LL&E, and 2.2 West Texas-Sweet (% by volume)

Dewaxing experiments in Examples 1-5 were carried out in a bench-scale fixed bed reactor in downflow configuration. The reactor had a 1-3/16 inch internal diameter and thermocouple wells entering from the top and bottom. The reactor was loaded with 40 ml of catalyst (nominal 1/16 inch extrudates) following which the void space in the catalyst bed was filled with 16 ml of 80-200 mesh silica. The catalyst bed height was about 5 inches. Six inches of glass beads above the catalyst bed served as a preheat zone for the feed in the reactor.

The catalyst was gradually heated to 450° F. (over a 4 hour period) under a hydrogen flow of 1 L/min at 600 psig. Next, the catalyst was gradually heated (over a 4 hour period) to 700° F. under a $H_2S/H_2$ (10% $H_2S$) flow of 0.5 L/min at 40 psig. After a 1 hour hold at 700° F. the catalyst was purged for 4 hours with hydrogen at 0.2 L/min and 500 psig.

The feed was cut into the reactor at 1 LHSV and the hydrogen flow was adjusted to 2500 SCFB after which the conditions were allowed to stabilize over a 12 hour period. Samples were collected at 4 hour intervals and stripped with nitrogen at 350 sccm at 275° F. for 4 hours. The stripped product was collected and analyzed for pour point and viscosity at 40° and 100° C. The viscosity indices were calculated according to the method of ASTM D 2270. The pour points were determined according to the method of ASTM D 97. Dewaxed oil (DWO) yield was calculated by dividing the weight of liquid product collected after stripping by the weight of feed entering the reactor during the collection period.

The following examples illustrate the practice of this invention without being limiting upon the scope thereof.

Example 1

Example of Invention

A mixture of 80 wt. % ZSM-5 (molar ratio of $SiO_2/Al_2O_3=50$) and 20 wt. % alumina was extruded to form a nominal 1/16 inch extrudate employed as the catalyst support in this example.

The extrudate was air calcined at 1000° F. 90.0 grams of the calcined extrudate was impregnated with 7.13 grams of nickel nitrate hexahydrate and 6.18 grams of ammonium metatungstate (73.8 wt. % W) in 53 grams of water. The wet catalyst was then air dried and calcined at 1000° F.

The final catalyst had a calculated nickel oxide (NiO) content of about 1.9 wt. % and a calculated tungsten oxide ($WO_3$) content of about 5.9 wt. %.

The catalyst was evaluated for dewaxing performance using the feedstock and procedure described previously. Dewaxing conditions and the dewaxed oil yield and product properties are shown in Table II.

TABLE II

CATALYTIC DEWAXING
Example 1
CONDITIONS: 500 psig, 2500 SCFB, 1 LHSV

| TEST PERIOD | 1 | 7 | 3 | 4 | 5 | 6 | 7 | 8 |
|---|---|---|---|---|---|---|---|---|
| Catalyst Age, HR | 8-24 | 32-48 | 60-76 | 84-104 | 108-120 | 136-152 | 176-192 | 196-216 |
| Temperature °F. | 500 | 525 | 540 | 542 | 547 | 552 | 558 | 585 |
| Pour Point, °F. | 65 | 45 | 10 | 20 | 5 | 5 | 10 | −20 |
| Dewaxed Oil Yield wt. % | 90.7 | 82.5 | 76.6 | 77.4 | 75.6 | 75.6 | 75.9 | 69.9 |
| Viscosity Index | 108 | 101 | 96 | 97 | 96 | 96 | 96 | 86 |
| Viscosity, SUS, 100° F. | 99 | 107 | 116 | 116 | 116 | 117 | 116 | 130 |

Example 2

Example of Invention

A mixture of 80 wt. % ZSM-5 (molar ratio of $SiO_2/Al_2O_3=50$) and 20 wt. % alumina was extruded to form a nominal 1/16 inch employed as the catalyst support in this Example. The zeolite employed was of a different lot than that utilized in Example 1.

The extrudate was air calcined at 1000° F. after which 90.0 grams of the calcined extrudate was impregnated with 7.13 grams of nickel nitrate hexahydrate and 6.18 grams of ammonium netatungstate (73.8 wt. % W) in 53 grams of water. The wet catalyst was then air dried and calcined at 1000° F.

The final catalyst had a calculated nickel oxide content of about 1.9 wt. % and a calculated tungsten trioxide content of about 5.9 wt. %.

The catalyst was evaluated for dewaxing performance using the feedstock and procedure previously described above. The dewaxing conditions, dewaxed oil yield and product properties are shown in Table III below.

TABLE III

CATALYTIC DEWAXING
Example 2
CONDITIONS: 500 psig, 2500 SCFB, 1 LHSV

| TEST PERIOD | 1 | 2 | 3 | 4 | 5 | 6 |
|---|---|---|---|---|---|---|
| Catalyst Age, HR | 8–24 | 28–44 | 96–124 | 124–144 | 156–180 | 192–216 |
| Temperature °F. | 500 | 525 | 551 | 557 | 559 | 585 |
| Pour Point °F. | 70 | 45 | 15 | 5 | 20 | −15 |
| Dewaxed Oil Yield, wt. % | 90.1 | 81.4 | 74.4 | 74.0 | 75.4 | 70.4 |
| Viscosity Index | 110 | 102 | 94 | 93 | 96 | 88 |
| Viscosity, SUS, 100° F. | 97 | 107 | 117 | 118 | 116 | 128 |

Example 3 (Comparative)

A mixture of 80 wt. % ZSM-5 ($SiO_2/Al_2O_3=31$) and 20 wt. % alumina was extruded to form a nominal 1/16 inch extrudate used as the catalyst support in this Example.

The extrudate was air calcined at 1000° F. 63.8 grams of the calcined extrudate was impregnated with 5.42 grams of nickel nitrate hexahydrate and 4.71 grams of ammonium metatungstate (73.8 wt. % W) in 28 grams of water. The wet catalyst was then air dried and calcined at 1000° F.

The final catalyst had a calculated nickel oxide (NiO) content of about 2.0 wt. % and a calculated tungsten oxide ($WO_3$) content of about 6.3 wt. %.

The catalyst was evaluated for dewaxing performance using the feedstock and procedure described above. Dewaxing conditions, dewaxed oil yield and product properties are shown in Table IV.

TABLE IV

CATALYTIC DEWAXING
Example 3
CONDITIONS: 500 psig, 2500 SCFB, 1 LHSV

| TEST PERIOD | 1 | 2 | 3 | 4 | 5 |
|---|---|---|---|---|---|
| Catalyst Age, HR | 8–24 | 28–44 | 48–68 | 104–116 | 128–136 |
| Temperature, °F. | 500 | 540 | 570 | 580 | 595 |
| Pour Point, °F. | 70 | 45 | 15 | 25 | 0 |
| Dewaxed Oil Yield, wt. % | 88.3 | 77.1 | 69.4 | 71.4 | 67.2 |
| Viscosity Index | 111 | 98 | 86 | 88 | 85 |
| Viscosity, SUS, 100° F. | 99 | 115 | 132 | 128 | 132 |

Example 4 (Comparative)

A mixture of 80 wt. % ZSM-5 (molar ratio of $SiO_2/Al_2O_3=140$) and 20 wt. % alumina was extruded to form a nominal 1/16 inch extrudate which was utilized as the catalyst support in this Example.

The extrudate was air calcined at 1000° F. and 81.7 grams of the calcined extrudate was impregnated with 6.94 grams of nickel nitrate hexahydrate and 6.01 grams of ammonium metatungstate (73.8 wt. % W) in 35.1 grams of water. The wet catalyst was then air dried and calcined at 1000° F.

The final catalyst had a calculated nickel oxide (NiO) content of about 2.0 wt. % and a calculated tungsten oxide ($WO_3$) content of about 6.3 wt. %.

This catalyst was evaluated for dewaxing performance using the feedstock and procedure previously outlined. Dewaxing conditions, the dewaxed oil yield and product properties are shown in Table V below.

TABLE V

CATALYTIC DEWAXING
Example 4
CONDITIONS: 500 psig, 2500 SCFB, 1 LHSV

| TEST PERIOD | 1 | 2 | 3 | 4 | 5 | 6 |
|---|---|---|---|---|---|---|
| Catalyst Age, HR | 12–28 | 40–56 | 92–100 | 196–208 | 208–220 | 220–232 |
| Temperature, °F. | 500 | 550 | 545 | 548 | 550 | 553 |
| Pour Point, °F. | 65 | −25 | −5 | 30 | 20 | 10 |
| Dewaxed Oil | 88.9 | 67.8 | 70.9 | 77.2 | 74.2 | 73.9 |

TABLE V-continued

| CATALYTIC DEWAXING Example 4 CONDITIONS: 500 psig, 2500 SCFB, 1 LHSV | | | | | | |
|---|---|---|---|---|---|---|
| TEST PERIOD | 1 | 2 | 3 | 4 | 5 | 6 |
| Yield, wt. % | | | | | | |
| Viscosity Index | 109 | 85 | 87 | 94 | 92 | 91 |
| Viscosity SUS, 100° F. | 100 | 131 | 125 | 118 | 116 | 121 |

Example 5 (Comparative)

A mixture of 80 wt. % ZSM-5 (molar ratio of $SiO_2/Al_2O_3=51$) and 20 wt. % alumina was extruded to form a nominal 1/16 inch extrudate which was employed as the support in this Example.

The extrudate was air calcined at 1000° F. after which 100 grams of the calcined extrudate was impregnated with 7.92 grams of nickel nitrate hexahydrate and 6.86 grams of ammonium metatungstate (73.8 wt. % W) in 31 grams of water. The wet catalyst was then air dried and calcined at 1000° F.

The final catalyst had a calculated nickel oxide (NiO) content of about 1.9 wt. % and a calculated tungsten oxide ($WO_3$) content of about 5.9 wt. %.

The catalyst was evaluated for dewaxing performance using the feedstock and procedure previously outlined. Dewaxing conditions, dewaxed oil yield and product properties are shown in Table VI below.

TABLE VI

| (Comparative) CATALYTIC DEWAXING Example 5 CONDITIONS: 500 psig, 2500 SCFB, 1 LHSV | | | | | | |
|---|---|---|---|---|---|---|
| TEST PERIOD | 1 | 2 | 3 | 4 | 5 | 6 |
| Catalyst Age, HR | 12-32 | 52-68 | 152-168 | 184-200 | 208-220 | 252-284 |
| Temperature, °F. | 500 | 525 | 538 | 550 | 548 | 546 |
| Pour Point, °F. | 60 | 30 | 20 | −25 | −15 | 10 |
| Dewaxed Oil Yield, wt. % | 85.8 | 74.6 | 71.6 | 67.7 | 68.4 | 71.0 |
| Viscosity Index | 104 | 91 | 89 | 83 | 85 | 88 |
| Viscosity, SUS, 100° F. | 106 | 120 | 124 | 131 | 128 | 125 |

The specific pore size distribution as measured by nitrogen adsorption using a Micrometrics ASAP 2400 Instrument for the catalysts of this invention as described in Examples 1 and 2 and for the catalysts described in Comparative Examples 3, 4 and 5 is set out in Table VII below:

TABLE VII

| CATALYST PORE VOLUME DISTRIBUTION | | | | | |
|---|---|---|---|---|---|
| PORE DIAMETER RANGE | EX 1 | EX 2 | EX 3 | EX 4 | EX 5 |
| 45-70Å, % PV* | 9 | 9 | 40 | 70 | 8 |
| 70-200Å, % PV* | 77 | 83 | 38 | 23 | 42 |
| 200-600Å, % PV* | 14 | 8 | 22 | 7 | 50 |
| <100Å, % TPV | 55 | 56 | 81 | 94 | 47 |
| <150Å, % TPV | 81 | 86 | 86 | 95 | 58 |
| >200Å, % TPV | 10 | 6 | 12 | 4 | 34 |
| 100-150Å, % TPV | 25 | 31 | 5 | 1 | 11 |

TABLE VII-continued

| CATALYST PORE VOLUME DISTRIBUTION | | | | | |
|---|---|---|---|---|---|
| PORE DIAMETER RANGE | EX 1 | EX 2 | EX 3 | EX 4 | EX 5 |
| 150-200Å, % TPV | 9 | 7 | 3 | 1 | 8 |

*% PV = PERCENT OF PORE VOLUME BETWEEN 45-600Å.

The desired product from the process of this invention has a pour point of +10° to +15° F. In Table VIII below a summary of the yield and VI values obtained for a +10° to +15° F. pour point of products obtained in Examples 1-5. These data clearly show the superior VI values and dewaxed oil yields achieved with the products of Examples 1 and 2.

TABLE VIII

VISCOSITY INDEX AND DEWAXED OIL YIELD FOR PRODUCTS WITH +10° TO +15° F. POUR POINT

| EXAMPLE | VISCOSITY INDEX | DEWAXED OIL YIELD (wt. %) |
|---|---|---|
| 1 | 96 | 76 |
| 2 | 94 | 74 |
| 3 | 86 | 69 |
| 4 | 91 | 74 |
| 5 | 88 | 71 |

Figure 2:
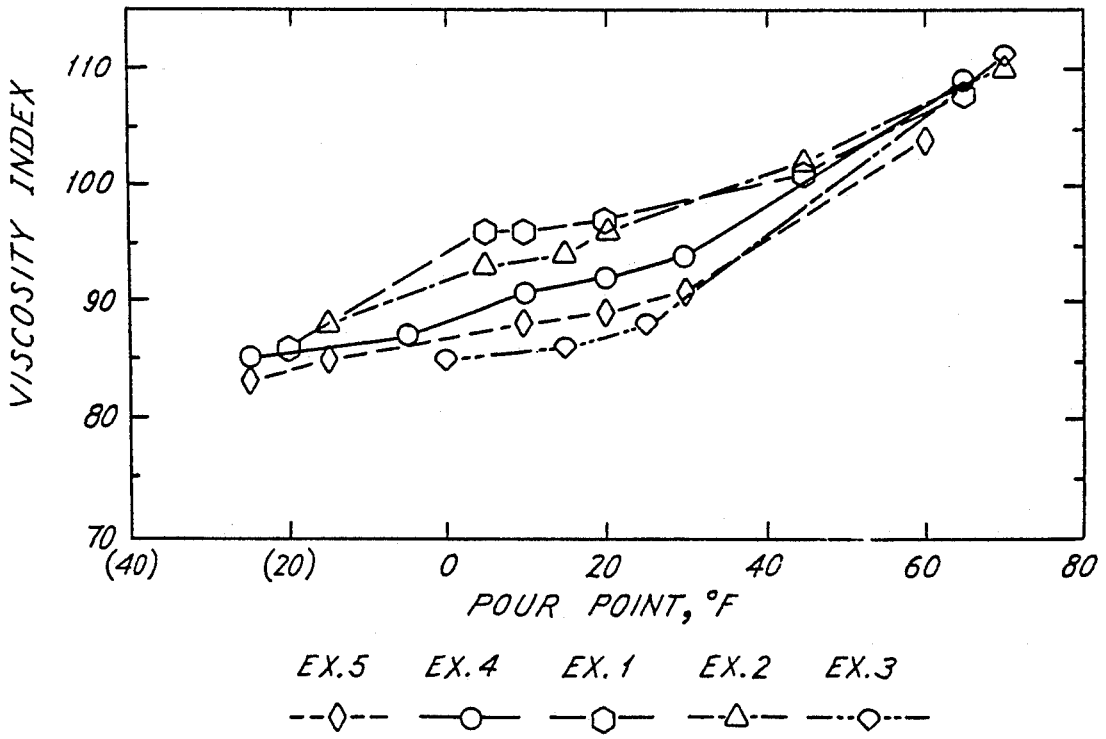
FIG. 2 shows viscosity index values of dewaxed oil samples derived from Examples 1 and 2 of the present invention and from Comparative Examples 3, 4 and 5 plotted against the pour point (°F.) using data from Tables II-VI.

FIG. 1 is a plot of the yield vs. pour point while FIG. 2 is a plot of the VI vs. pour point data in Tables 2-6. It can be seen in these figures that Examples 1 and 2 give both the best yield and VI over the entire pour point range.

The desired product from this process has a pour point of +10° to +15° F. Table VIII shows a summary of the yield and VI obtained for a +10° to a +15° F. pour point product for each catalyst example. Again, Examples 1 and 2 show better VI and yield than the other examples.

Figure 3:
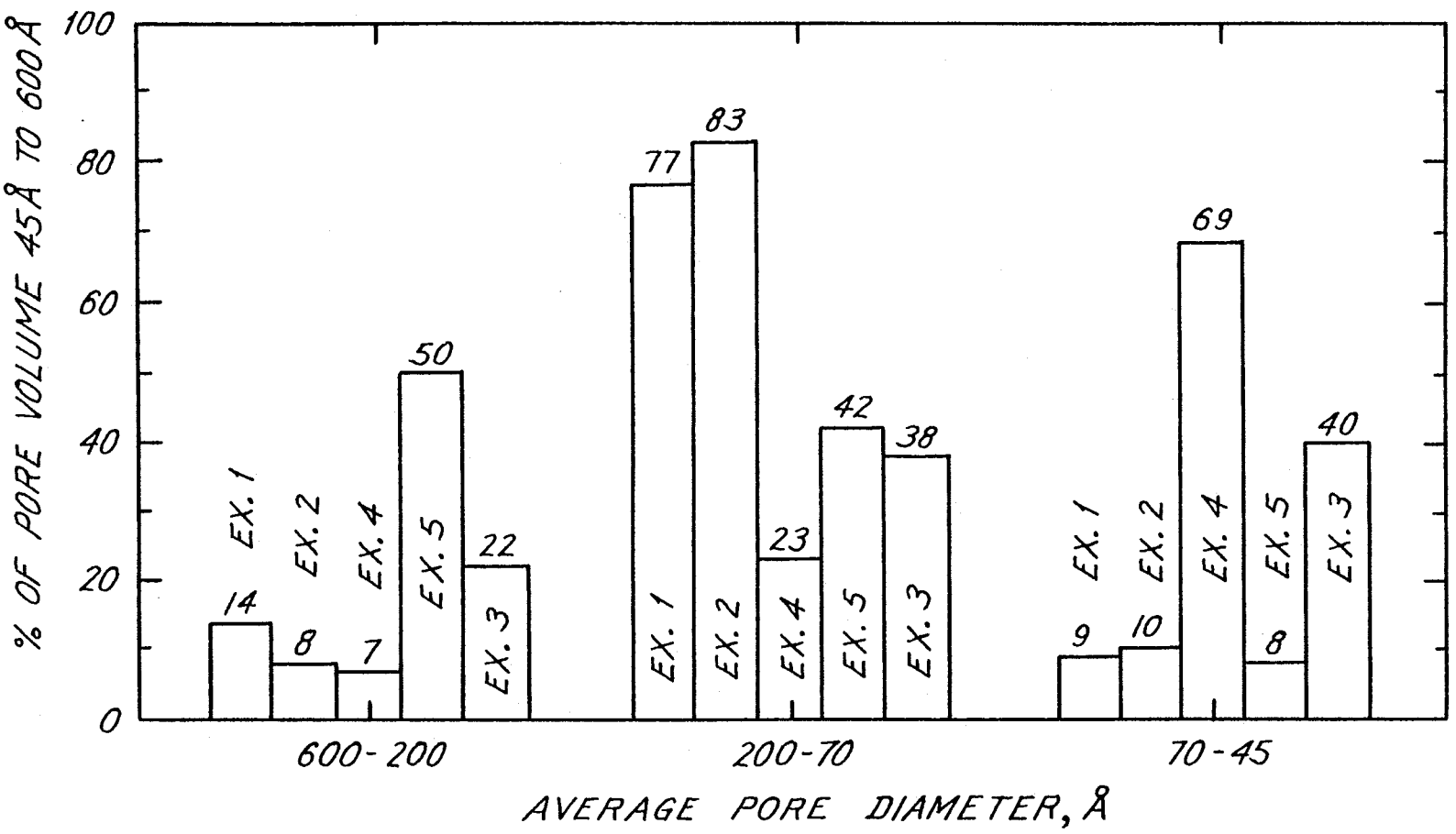
FIG. 3 shows graphically the percent of pore volume between 44-600 Angstroms in the range of (a) 45-70 Å, (b) 70-200 Å, and (c) 200-600 Å for each of the catalysts of Examples 1-5 incl.

FIG. 3 shows the percent of the pore volume between 45–600 Å summed over three different ranges of pore diameters. It is seen from this figure that Examples 1 and 2 show a high percentage (>75%) of pore volume in the 200–70 Å range. This is a significant feature of the present invention.

What is claimed is:

1. A process for hydrodewaxing a hydrocarbon oil feedstock boiling above about 350° F. which comprises contacting said feedstock and hydrogen at a hydrogen pressure of from about 300 to about 2000 psig, a temperature of from about 400 ° to about 900° F. and a space velocity of about 0.1 to about 10 LHSV, with a catalyst comprising about 0.1 to about 23 wt. %, based on the total weight of the catalyst, of at least one metal oxide selected from the group consisting of a Group VIII metal and an oxide of a Group VIB metal supported on a porous support comprising alumina containing about 50 to about 85 wt. % of a crystalline aluminosilicate zeolite based on the weight of the support, and wherein the catalyst is further characterized by having greater than about 60% of the pore volume of pores having diameters between 45–600 Angstroms in the 70 to 200 Angstrom range and having about 50 to about 60% of the total pore volume in pores having diameters less than 100 Angstroms.

2. The process of claim 1 wherein the hydrocarbon oil feedstock is a waxy stock boiling in the range of about 350° to about 1100° F.

3. The process of claim 1 wherein the hydrocarbon oil feedstock is light neutral waxy distillate stock boiling in the range of about 600° to about 1000° F.

4. The process of claim 2 wherein the hydrocarbon oil feedstock is a waxy solvent-refined stock.

5. The process of claim 1 wherein the catalyst contains an oxide of a Group VIB metal.

6. The process of claim 5 wherein the catalyst contains a nickel oxide.

7. The process of claim 1 wherein the catalyst contains an oxide of a Group VIII metal.

8. The process of claim 7 wherein the catalyst contains an oxide of tungsten.

9. The process of claim 1 wherein the catalyst contains an oxide of a Group VIB metal and an oxide of a Group VIII metal.

10. The process of claim 1 wherein the catalyst contains an oxide of nickel and an oxide of tungsten.

11. The process of claim 1 wherein the catalyst contains about 2 wt. % of an oxide of nickel and about 6 wt. % of an oxide of tungsten.

12. The process of claim 1 wherein the crystalline aluminosilicate zeolite in the catalyst is selected from the group consisting of ZSM-5, ZSM-11, ZSM-12, ZSM-23, ZSM-35, ZSM-38 and mordenite.

13. The process of claim 1 wherein the zeolite in the catalyst is in the hydrogen form.

14. The process of claim 1 wherein in the catalyst the crystalline aluminosilicate zeolite is ZSM-5 zeolite.

15. The process of claim 1 wherein in the catalyst the matrix is alumina.

16. The process of claim 1 wherein in the catalyst the matrix is alumina, the zeolite is ZSM-5 and the catalyst contains an oxide of nickel and an oxide of tungsten.

17. The process of claim 1 wherein the hydrogen circulation rate ranges from about 1000 to about 15,000 SCFB.

18. The process of claim 1 wherein the catalyst is further characterized by having about 50 to about 60 % of the total pore volume in pores having diameters less than 100 Angstroms and 81 to 86% of the total pore volume in pores having diameters less than 150 Angstroms.

* * * * *